United States Patent [19]

Burbidge et al.

[11] Patent Number: 4,659,925

[45] Date of Patent: Apr. 21, 1987

[54] HIGH PRESSURE WELL RADIOISOTOPE INJECTION SYSTEM

[75] Inventors: George A. Burbidge, Nepean; Judy E. Stuart, Mississauga, both of Canada

[73] Assignee: Atomic Energy of Canada Limited, Ontario, Canada

[21] Appl. No.: 658,781

[22] Filed: Oct. 9, 1984

[30] Foreign Application Priority Data

Mar. 15, 1984 [CA] Canada ..... 449666

[51] Int. Cl.[4] ..... G01V 5/00

[52] U.S. Cl. ..... 250/260

[58] Field of Search ..... 250/260, 259, 497.1

[56] References Cited

U.S. PATENT DOCUMENTS 3,564,255 2/1971 Massey ..... 250/497.1

4,199,680 4/1980 Moon ..... 250/260

4,421,982 12/1983 Potter et al. ..... 250/260

*Primary Examiner*—Janice A. Howell

*Attorney, Agent, or Firm*—Lewis H. Eslinger; Alvin Sinderbrand

[57] ABSTRACT

This invention relates to a system for injecting radioactive tracers into a fluid line such as that of an injection oil well. The radioactive material is located in a vial within the shipping container. The vial is pierced by fluid carrying lines and the radioactive material is then transferred via the carrier fluid to a previously evacuated pressure flask. The pressure flask is then isolated from the line leading to the vial and fluid from the high pressure injection line is introduced into the pressure flask to flush the radioactive material into the high pressure line and thus into the injection well.

14 Claims, 2 Drawing Figures

HIGH PRESSURE WELL RADIOISOTOPE INJECTION SYSTEM

Figure 1:
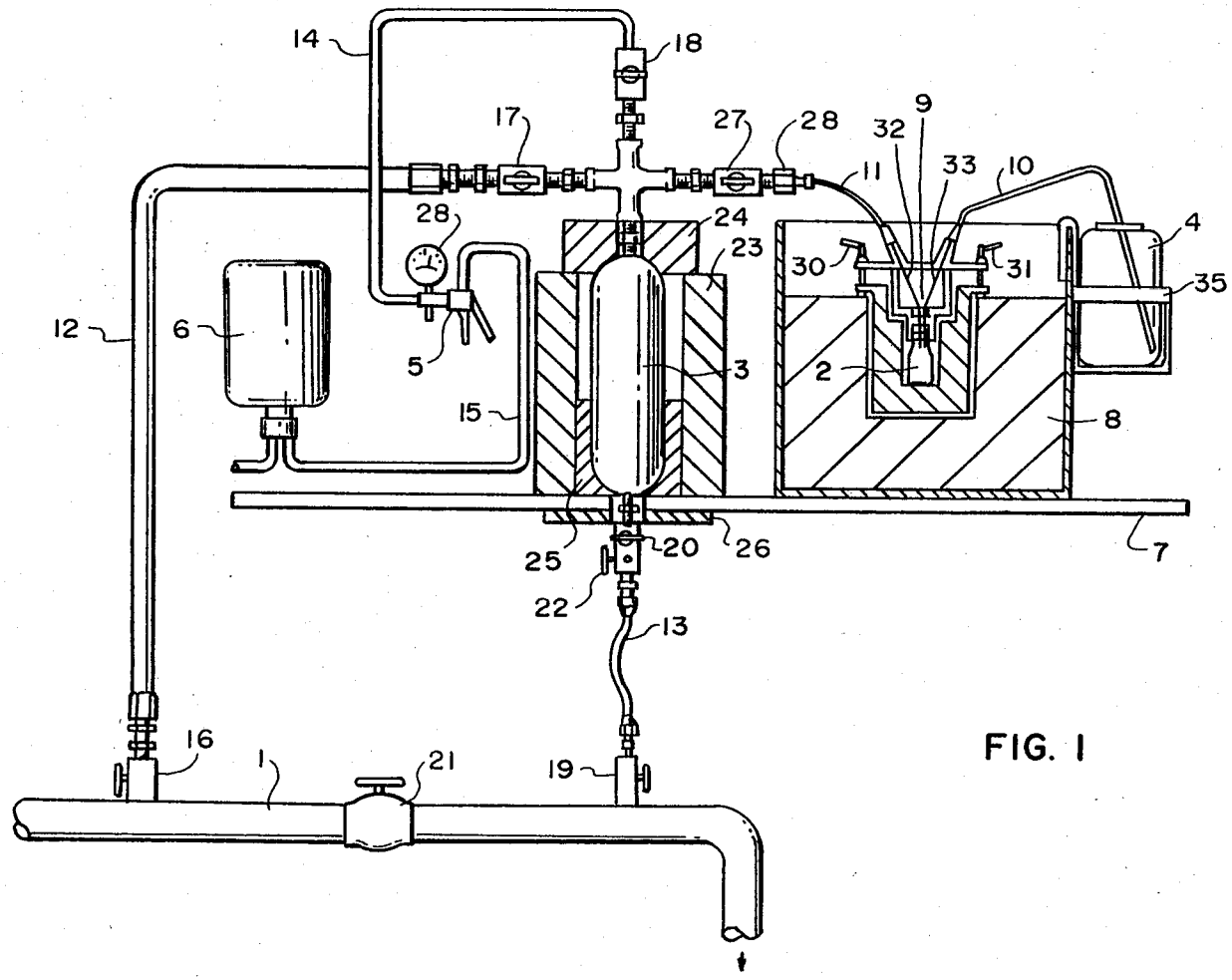

This invention relates to the injection of radioisotope tracers into high pressure fluid systems, and particularly into high pressure fluid systems. It finds application in the injection of such tracers into the high pressure fluid line of injection oil, gas, and geothermal wells. However, it is capable of handling the injection of radioisotopes into other flow systems such as a heat exchanger of refinery piping system.

In an injection oil well water or other fluid under high pressure is used to force the oil in the reservoir to the producing wells and thus enhance the amount of oil recovered from the field.

Radioactive tracers are often used in oil technology. A recent article in the Journal of Petroleum Technology, May 1981, pages 779 to 782, by John A. D'Hooge, Clyde Q. Sheely, and Billy J. Williams is a good indication of such interest. The radioactive tracers are used to determine the direction of fluid movement in the reservoir. They are said to "maximize sweep efficiencies and optimize depletion plans" in enhanced oil recovery programs.

The generally used prior art method of injection of the radioactive material is to attach a vial crushing unit to the well head, transfer the radionuclide to the vial crusher, crush the vial, and then flush the injection water through the vial crusher to sweep the activity into the well. With the use of a vial there is the very distinct disadvantage that glass particles can be caught up in valves and fittings; also, vial fragments must be retrieved from a strainer and disposed of as active waste creating a radioactive contamination hazard to personnel.

In the system of the present invention, the radioactive solution is pneumatically transferred from the vial within the shipping container to a shielded high pressure flask from which it is flushed into the well with injection fluid. Thus, with the system of the present invention there is no need to remove the vial from a shipping container and transfer it to a vial crusher. This very significantly reduces radiation exposure and it minimizes the chance of spillage or dropping of the container with resultant contamination of surroundings or personnel.

The apparatus and method of the present invention are suitable for use with all radioisotopes used for inter-well tracing. Examples of such radioisotopes are tritium, carbon-14, cobalt-57, cobalt-60, cesium-134 cesium-137 and strontium 90.

It is to be understood that the above-noted radioisotopes are exemplary only. Other radioisotopes may be used.

The radionuclides are shipped individually in licensed shipping containers as solutions in septum sealed vials inside leak-proof inserts.

Prior to introduction of the radionuclide the injection well will be checked for pressure, flow rate and casing integrity. The apparatus consists of modular injection components which are installed on an adjustable stand.

A suitable means such as a vertically movable injection block containing two piercing hypodermic needles is attached to the shipping container and attached to the block are input and output fluid carrying lines. When the injection block is forced downwards using toggle clamps, the needles are inserted into the vial causing the radioactive fluid to transfer in the carrying lines. A shielded pressure flask is connected to the high pressure fluid line and to the output line of the vial containing the radionuclide. The input line to the vial is connected to a container of carrier fluid. The pressure flask is first evacuated when isolated from the high pressure line and the line to the vial by shut-off valves. The valve in the output line of the vial is then opened to permit the carrier fluid to transfer the radionuclide into the pressure flask. After transfer, this valve is closed. High pressure fluid is then permitted to flow through the pressure flask to inject the radionuclide into the high pressure line and thus into the injection well.

It is an object of the present invention to provide an apparatus and method for injecting a radioactive tracer into a high pressure fluid line while minimizing radiation hazard and exposure.

In accordance with one broad aspect of the invention there is provided apparatus for adding radioactive tracer material into a high pressure line for fluid being pumped into an injection well comprising: a shielded pressure flask; a container of carrier fluid; a container of radioactive tracer material; means to evacuate said pressure flask; means to connect said container of radioactive tracer material to said shielded pressure flask and said container of carrier fluid so that after evacuation of said pressure flask said carrier fluid is transferred to said pressure flask carrying with it said radioactive material; and means to connect said shielded pressure flask to the high pressure line whereby said radioactive tracer material is flushed into the high pressure line.

According to another broad aspect of the invention there is provided a method of injecting radioactive tracer material from a shipping container into a high pressure line for fluid in a high pressure flow system comprising the steps of: transferring the radioactive tracer material from said shipping container to a shielded pressure flask by means of a carrier fluid; injecting fluid from said high pressure line into said shielded pressure flask thereby to flush said radioactive tracer material therefrom into said high pressure line.

Figure 2:
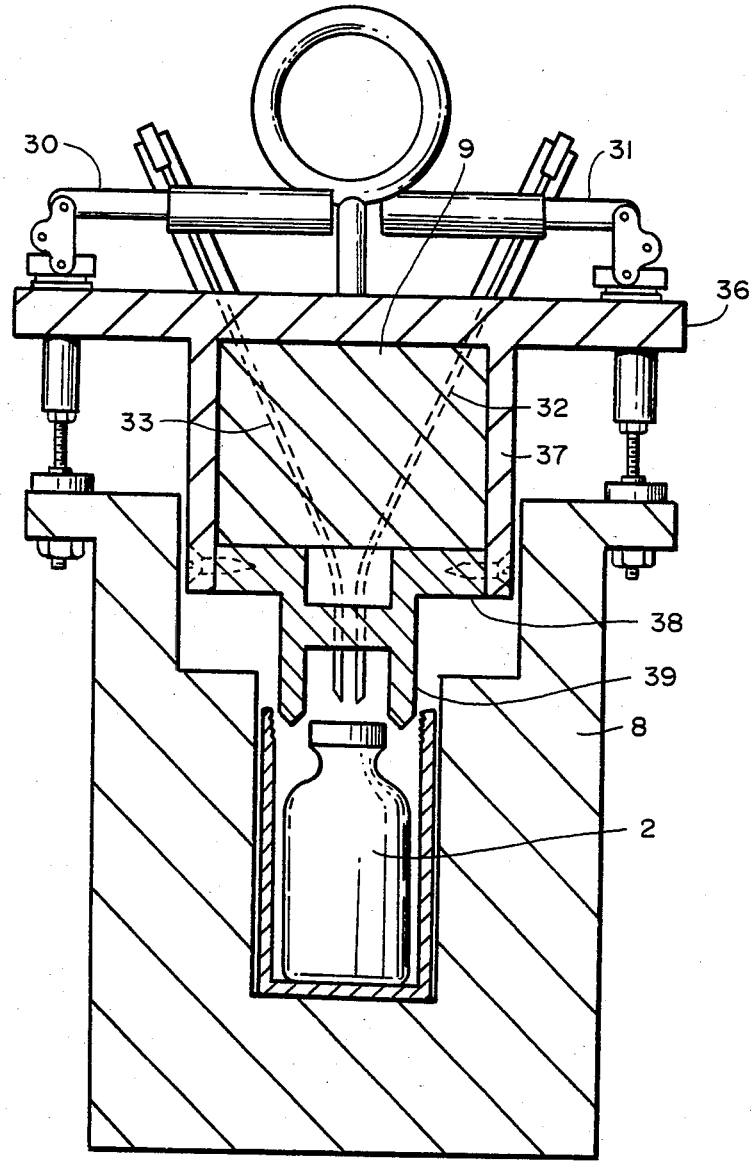

An exemplary embodiment of the invention will now be described which is to be read in conjunction with the attached drawing in which:

FIG. 1 is a diagrammatic view showing the apparatus of the invention connected to a high pressure fluid line for an injection well; and FIG. 2 is a view showing the injection block assembly in cross-section.

As shown in FIG. 1, the apparatus is located adjacent high pressure fluid carrying line 1 and is mounted on stand 7.

The main components of the apparatus consist of the following:

A. The carrier flask 4 containing a selected charge of appropriate carrier;

B. Injection block 9;

C. Shipping container 8 containing the vial 2 of radionuclide;

D. Pressure vessel 3 and connections;

E. Vacuum pump 5 with a vacuum gauge 28;

F. Air trap 6;

G. Radiation shielding for pressure vessel 3 which includes lead blocks 23 and 24 and lead plate 26;

H. Lead cradle 25.

Using the injection block and a dummy shipping container, the stand is adjusted for fit as components are installed.

As noted, the radioactive material is contained in vial 2 which is located in the shipping container 8, vial 2 surrounded by radiation shielding. The carrier liquid contained in flask 4, shown at the right side of the injection block 9 is used to flush the radioactive material from vial 2 into pressure flask 3. To this end there are provided fluid conducting lines 10 and 11 connected to hypodermic needles 32 and 33 which are attached to the vertically movable injection block 9 mounted above vial 2. When the radionuclide is to be transferred to pressure flask 3, toggles 30 and 31 are operated so as to cause these needles to pierce the vial.

Valves 16, 17, 18, 19, 20, 21, 22 and 27 are located in the various lines as shown in the drawing in order to control the flow therein during the procedure of transferring the radionuclide from vial 2 to the high pressure fluid line 1.

It is obviously of vital importance that substantially all the radioactive material be transferred from the vial to pressure flask 3. In order to determine this, prior to the injection of the radioactive material, a dummy run is effected using a vial of dye, such as potassium permanganate, instead of the radioactive material, in vial 2, and with the carrier flask 4 filled with water. The purpose of this dummy run is to determine that the equipment is operating properly, without leaks, and particularly that all the radioactive material is cleanly flushed out of the equipment including the vial 2, lines 10 and 11, and valve 27. With the equipment as shown in the drawing this transfer takes about 7 to 10 minutes. Testing with the dye, the colour should have virtually disappeared from the vial after the first 25% of the carrier has passed through into the pressure flask.

The procedure commences with the evacuation of pressure flask 3 by means of vacuum pump 5. With valve 18 open and all the other valves closed, the vacuum pump 5 is operated to create the appropriate vacuum in the pressure flask 3. After this, valve 18 is closed and the injection block lowered. Valve 27 is opened causing the carrier fluid in flask 4 to pass through line 10, to enter vial 2 via line 33 and to pass from the vial to pressure flask 3 by way of lines 32 and 11, carrying with it the radioactive material. Check valve 28 prevents the carrier fluid from back flowing through line 12 and valve 27. When substantially all the carrier fluid has been transferred, valve 27 is closed. In order to minimize radiation dose to personnel, valve 27 is opened with a remote actuator.

Thereafter, the radioactive material is flushed from pressure flask 3 into the high pressure line by opening valves 16, 17, 19 and 20 in that order. Throttle valve 21 in the high pressure line is then closed slowly to ensure flushing of the flask. Valve 20 is also opened with a remote actuator to minimize radiation hazard.

It is important that all the radioactive material be flushed from pressure flask 3. In carrying out the dummy run, when the high pressure fluid is flushed through pressure flask 3, a check is made for any seepage around the valves and fittings and also to determine if any dye has been retained in the pressure flask 3. To observe if any dye is present in the fluid, a quantity of fluid is drained from the system through drain valve 22.

Once the injection system is seen to be operating satisfactorily, the dummy shipping container is replaced with the shipping container containing the radioisotope. With toggles 30 and 31 in the "UP" position, the injection block 9 is lowered into the cavity of the shipping container. Using a mirror attached to a scaffold as a visual aid, the shipping container is rotated until the feet of the injection block are firmly in the footings of the shipping container. The carrier flask 4 is then filled with the appropriate carrier solution and attached to the system by means of the flask cradle 35. A radiation field monitor is employed to ensure that the radiation level is within safe limits. The toggles are then moved to the "LOWER" position causing the injection block needles to pierce the septum of vial 2.

FIG. 2 shows the injection block assembly in more detail. The injection block 9 is composed of lead and forms part of the shielding for vial 2. Surrounding block 9 is a steel casing comprising a cylindrical portion 37 and a bottom disc 38. Above block 9 is located support member 36 from which block 9 and the casing are suspended and upon which toggles 30 and 31 are mounted. Hypodermic needles 32 and 33 extend downwards through block 9 toward vial 2. Proper alignment of the vial with respect to the needles is ensured by cylindrical extension 39 of the bottom portion of the casing which closely surrounds the neck of the vial when the toggles are moved to the "LOWER" position causing the needles 32 and 33 to pierce the septum of vial 2.

Whereas in the foregoing example the radioactive materials are introduced in liquid form, it is also possible to inject gaseous radioisotopes into gas injection well systems. The principle will be basically the same except that the carrier will be atomospheric air or any other selected gas; the gaseous radioisotopes will comprise materials such as krypton-85, tritiated methane, and tritiated propane, and also gases such as carbon dioxide, methane, and propane with carbon-14 as the active isotope. Other selected gaseous radioisotopes are contemplated.

Many variations of both the apparatus and the method will occur to those skilled in the art. The invention includes all such variations as would occur to such person and is delineated, not by the preceding examples, but solely by the appended claims.

The embodiments of the invention in which an exclusive property or privilege is claimed are defined as follows:

1. Apparatus for adding radioactive tracer material into a high-pressure line for fluid being pumped into an injection well comprising:
   - a shielded pressure flask;
   - a container of carrier fluid;
   - a container of radioactive tracer material;
   - means to evacuate said pressure flask;
   - means to connect said container of radioactive material to said shielded pressure flask and to said container of carrier fluid so that after evacuation of said pressure flask said carrier fluid is transferred to said container of radioactive tracer material and thence to said pressure flask, said carrier fluid carrying with it said radioactive tracer material; and
   - means to connect said shielded pressure flask to the high-pressure line whereby said carrier fluid with said radioactive tracer material is flushed into the high-pressure line.

2. Apparatus as claimed in claim 1 wherein said means to connect said container of radioactive tracer material to said shielded pressure flask and said container of carrier fluid comprises fluid-conducting means adapted to pierce a septum of said container of radioactive tracer material, said container of radioactive material remaining whole, and valve means between said container of radio active tracer material and said shielded pressure flask.

3. Apparatus as claimed in claim 1 wherein said means to connect said shielded pressure flask to said high-pressure line comprises an input line to transfer high-pressure fluid from said high-pressure line into said shielded pressure flask and an output line to transfer high-pressure fluid and said carrier fluid with said radioactive tracer material from said shielded pressure flask to sid high-pressure line.

4. Apparatus as claimed in claim 3 wherein each of said input and output lines contains valve means adapted to isolate said high-pressure line from said shielded pressure flask prior to the introduction of the radioactive tracer material into said shielded pressure flask and to permit fluid from said high-pressure line to flow through said shielded pressure flask thereafter.

5. Apparatus as claimed in any one of claims 1 to 3 wherein said means to evacuate said pressure flask comprisess a vacuum pump.

6. Apparatus as claimed in any one of claims 1 to 3 wherein said radioactive tracer material is selected from the group comprising tritium, carbon-14, cobalt-57, cobalt-60, cesium-134, cesium-137 and strontium-90 and the carrier fluid is liquid.

7. Apparatus as claimed in any one of claims 1 to 3 wherein said radioactive tracer material is selected from the group comprising tritium, carbon-14, cobalt-57, cesium-134, cesium-137 and strontium-90 and the carrier fluid is gas.

8. Apparatus as claimed in claim 1 further comprising an adjustable stand, said shielded pressure flask, said container of carrier fluid, said container of radioactive tracer material and said means to evacuate said pressure flask being supported on said stand.

9. Apparatus as claimed in claim 7 wherein said means to connect said shielded pressure flask to said high pressure line comprises first and second flexible high pressure hoses and valve means in each of said first and second hoses to convey the flow of high pressure fluid to and from said shielded pressure flask respectively.

10. Apparatus as claimed in claim 8 further comprising a throttle valve in said high pressure line positioned and adjustable so as to augment the flow of high pressure fluid through said first and second flexible high pressure hoses and said shielded pressure flask when said valve means in said first and second flexible high pressure hoses are open.

11. Apparatus as claimed in claim 2 further comprising an injection block positioned above said container of radioactive tracer material and toggle means on said injection block and operable to cause said fluid-conducting means to pierce said container of radioactive tracer material, said toggle means being moveable to a first position in which said fluid-conducting means is spaced from said container of radioactive material and a second position in which said fluid-conducting means pierces said container of radioactive material.

12. A method of injecting radioactive material from a shipping container into a high-pressure line for fluid in a high pressure flow system comprising the steps of:

transferring the radioactive material from said shipping container to an evacuated shielded pressure flask by means of the suction in the evacuated pressure flask;

injecting fluid from said high pressure line into said shielded pressure flask thereby to flush said radioactive material therefrom into said high-pressure line.

13. The method of claim 12 wherein the high pressure flow system is an injection system for one of an oil well, a gas well and a geothermal well.

14. A method as claimed in claim 12 or 13 in which the procedure is first carried out using a dye instead of the radioactive tracer material in order to determine that the equipment is operating properly.

* * * * *